United States Patent [19]

Fogarasy

[11] 4,335,841

[45] Jun. 22, 1982

[54] WIRE STITCHERS

[75] Inventor: Attila A. Fogarasy, Jesmond, England

[73] Assignee: Xerox Corporation, Stamford, Conn.

[21] Appl. No.: 106,421

[22] Filed: Dec. 21, 1979

[30] Foreign Application Priority Data

Dec. 29, 1978 [GB] United Kingdom ..... 50324/78

[51] Int. Cl.[3] ..... B27F 7/21

[52] U.S. Cl. ..... 227/90; 227/87

[58] Field of Search ..... 227/87, 88, 89, 90, 227/152, 155

[56] References Cited

U.S. PATENT DOCUMENTS

| | | | |
|---|---|---|---|
| 263,391 | 8/1882 | Coop et al. | 227/90 |
| 445,139 | 1/1891 | Harper . | |
| 456,415 | 7/1891 | Howenstine | 227/90 |
| 804,864 | 11/1905 | Kennedy | 227/90 |
| 1,371,388 | 3/1921 | Nasmith . | |
| 1,880,327 | 10/1932 | Merz et al. | 227/90 |
| 2,285,489 | 6/1942 | Blanchard . | |
| 2,979,722 | 4/1961 | Nasmith et al. . | |

FOREIGN PATENT DOCUMENTS

| | | |
|---|---|---|
| 885841 | 12/1961 | United Kingdom . |
| 1086501 | 10/1967 | United Kingdom . |
| 1223840 | 3/1971 | United Kingdom . |

*Primary Examiner*—Paul A. Bell

*Attorney, Agent, or Firm*—Bernard A. Chiama

[57] ABSTRACT

A wire stitcher for binding sheets into sets in which cut lengths of wire are formed into staples about an anvil by a former and the formed staples are driven by a driver. The wire is gripped against the anvil by the driver during forming and the staple is supported with the aid of the anvil during driving. The driver has a two-stage action in which a first stage motion operates to grip the wire against the anvil during forming, the driver motion being arrested during forming, and a second stage motion acts following forming to effect driving. The movement of the driver and the former is effected by a continuous travel of an input lever.

8 Claims, 9 Drawing Figures

101
103
104
104a
105
106
107
108
109
110
120
121
122
123
124
125
138
139
201
202
203
204
205
206
207
208
209
210
217
55
W 412
413
107
190
415
173
414
406'
105'
404b
170
404a
101'
106'
104'
404'
104a'
72
402'
124'
144
149
407b
407a
145
74
143
411
202'
146
401'
201'
148
206'
147
205'
211
253
213
207'
209'
255
270
254
219
252
219a
251
218
250

WIRE STITCHERS

This invention relates to wire stitchers and particularly to such apparatus for binding sets or signatures of sheets or documents. Stitchers take various well-known forms. There are those (called staplers) which use preformed staples, those using pre-cut lengths of wire which are formed in the machine and those in which the staples are formed from a continuous wire wound on a spool from which pieces are cut and formed in the machine. In each case the legs of the formed staple or stitch are driven through the set until the crown of the staple lies against one face of the set and the ends of the staple legs are bent over against the opposite face of the set to form clinches. The present invention is concerned with stitchers of the kind in which the staples are formed in the stitcher either from wire stock or from pre-cut wire lengths.

From one aspect, the invention provides a wire stitcher having a two-stage driver action in which a first stage motion operates to grip the wire against an anvil about which the wire is formed into a staple, the driver motion being arrested during forming, and a second stage motion acts following forming to effect driving.

From another aspect, the invention provides a wire stitcher in which cut lengths of wire are formed into staples about an anvil and the formed staples driven by a driver, wherein the wire is gripped against the anvil by the driver during forming and the staple is supported with the aid of the anvil during driving.

Preferably, movement of the driver and a former by which the wire is formed about the anvil is effected by one continuous input lever travel.

From a further aspect, the invention provides a wire stitcher having a former for forming a length of cut wire into a staple about an anvil and a driver for driving the formed staple, in which movement of the driver and former is effected by a continuous travel of an input lever, the motion of the driver being arrested during forming.

In a preferred form of the invention the legs of a formed staple are supported during driving between the former and the anvil and the crown of the staple is supported by the anvil which is progressively retracted during driving.

The stitcher may be incorporated with a sheet stitcher/compiler as part of a finisher for a photocopier and such a finisher may form part of the photocopier or take the form of a separate unit.

Figure 1:
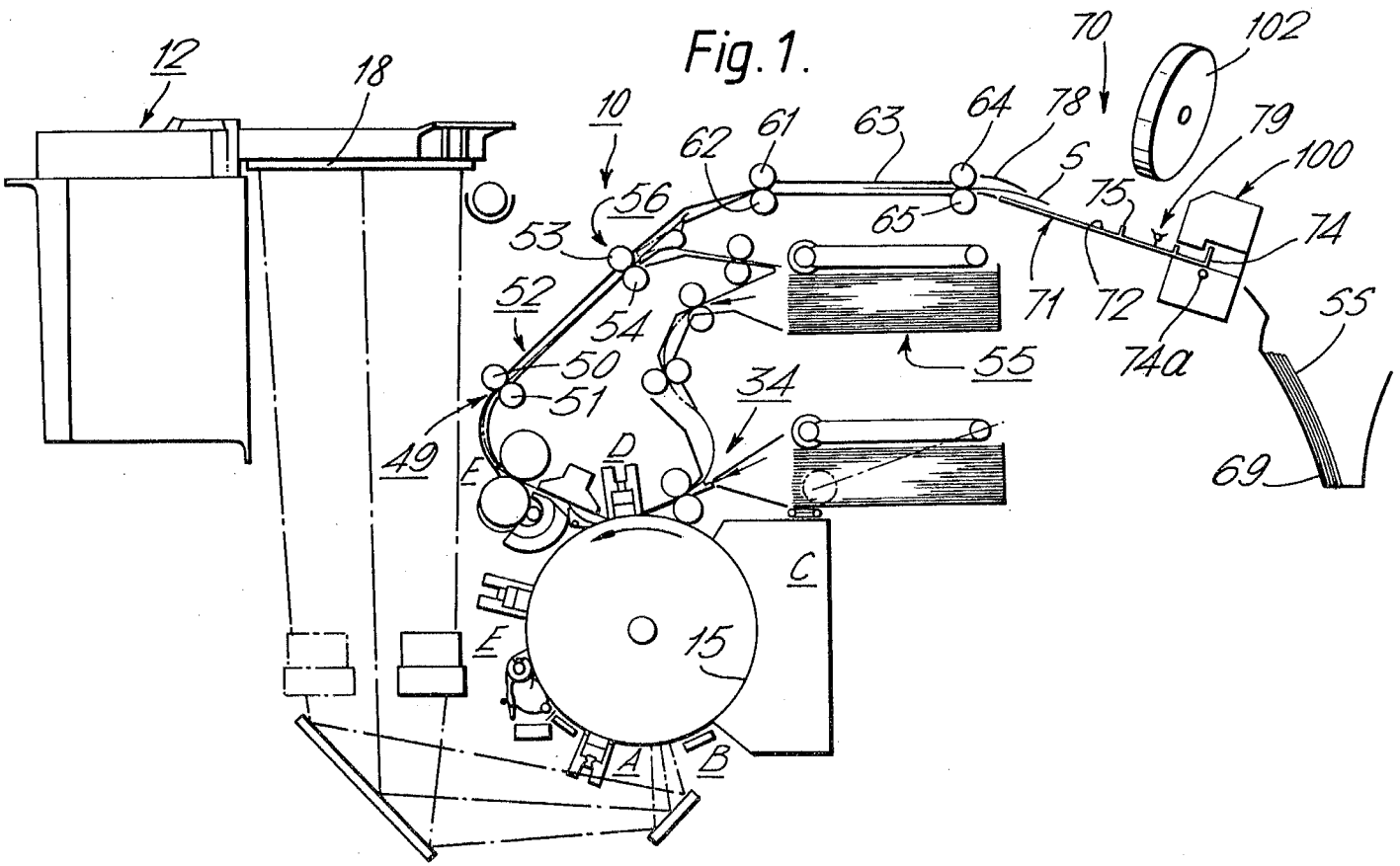
Figures 2, 3:
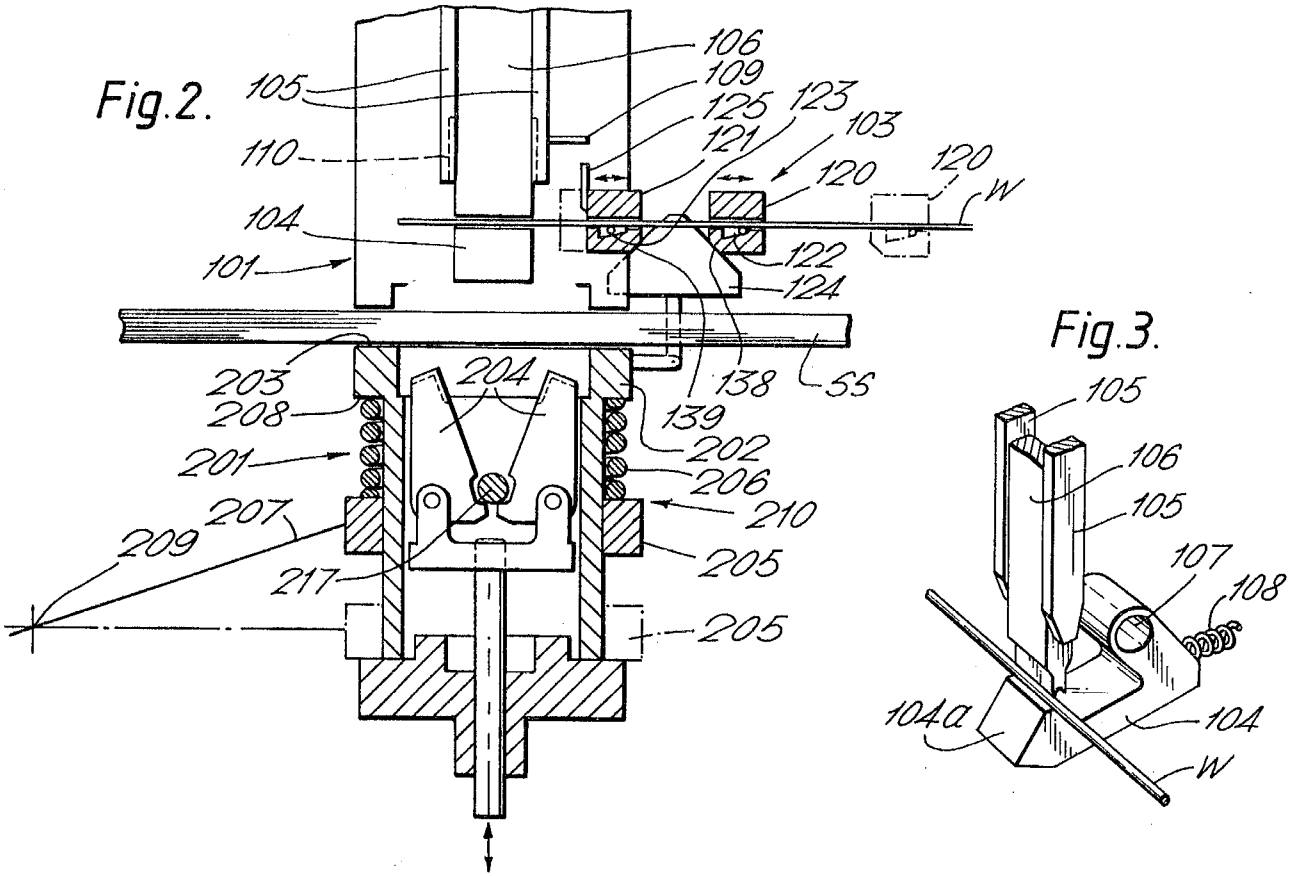
Figure 4:
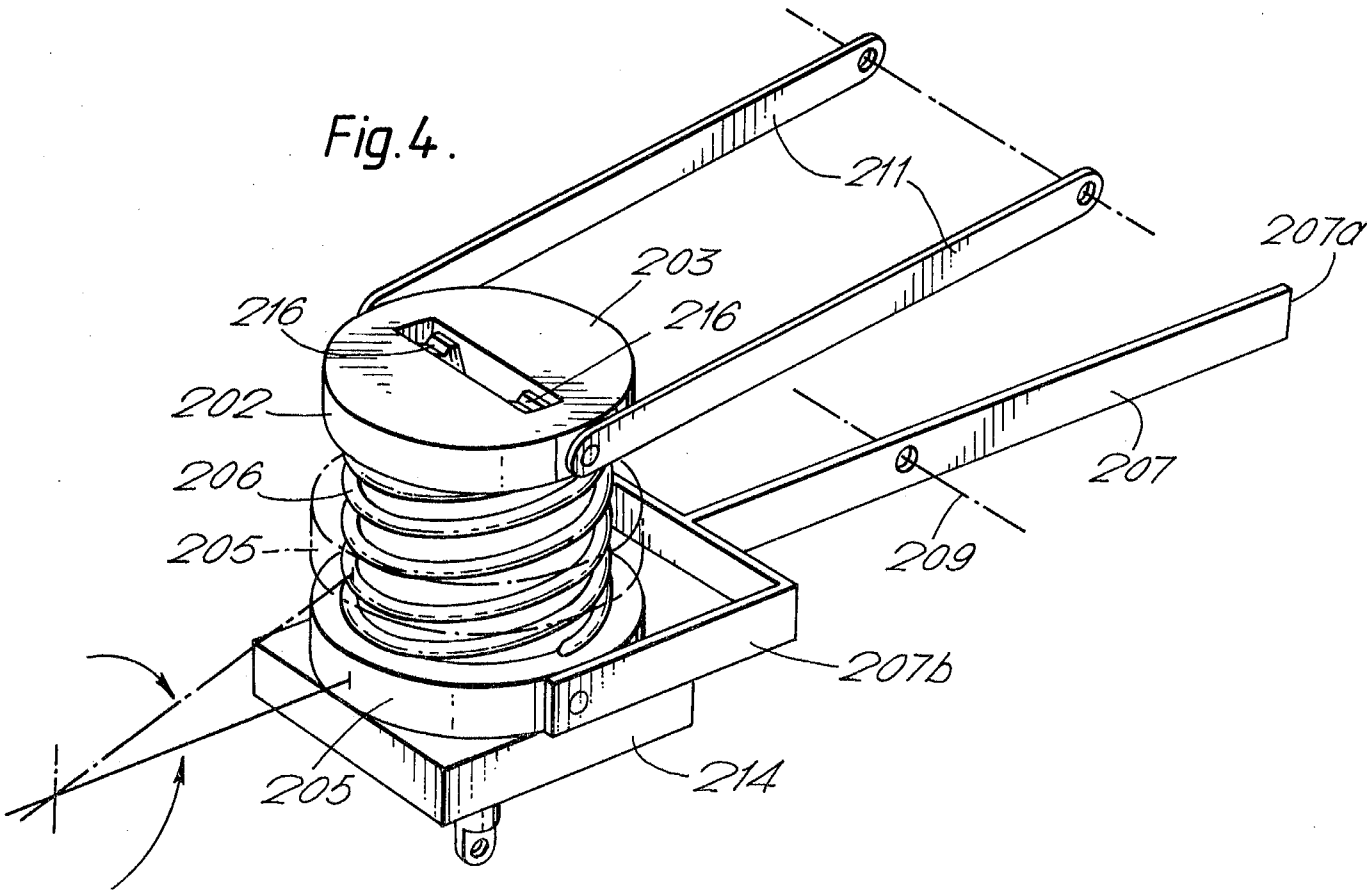
Figure 5:
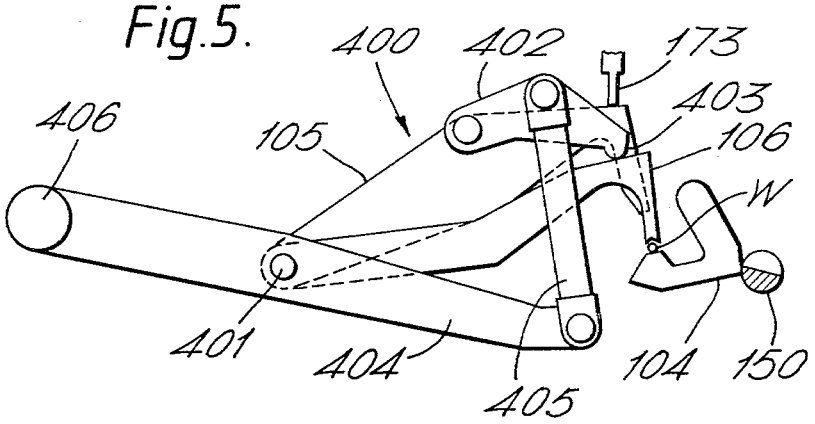
Figure 6:
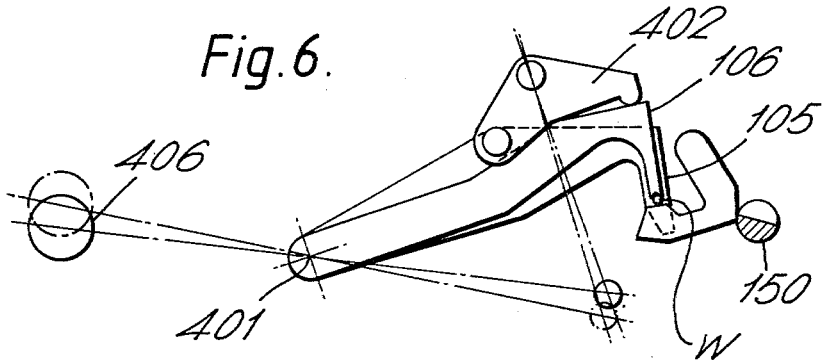
Figure 7:
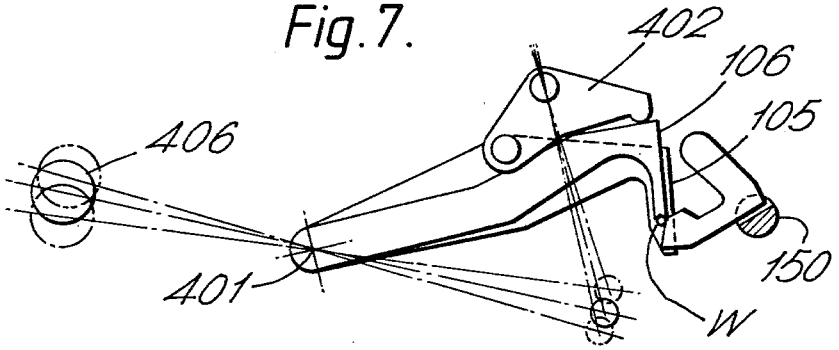
Figure 8:
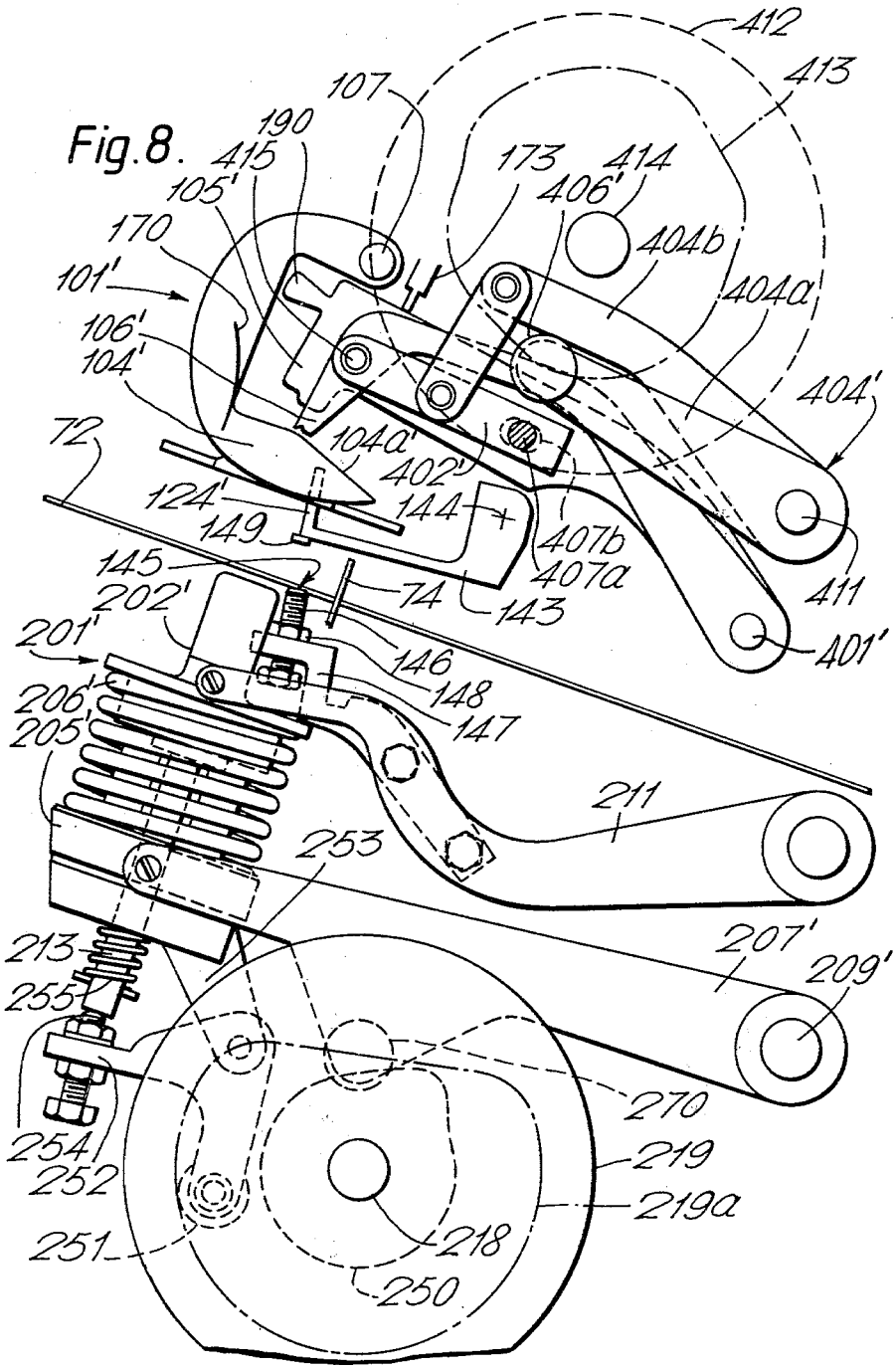
Figure 9:
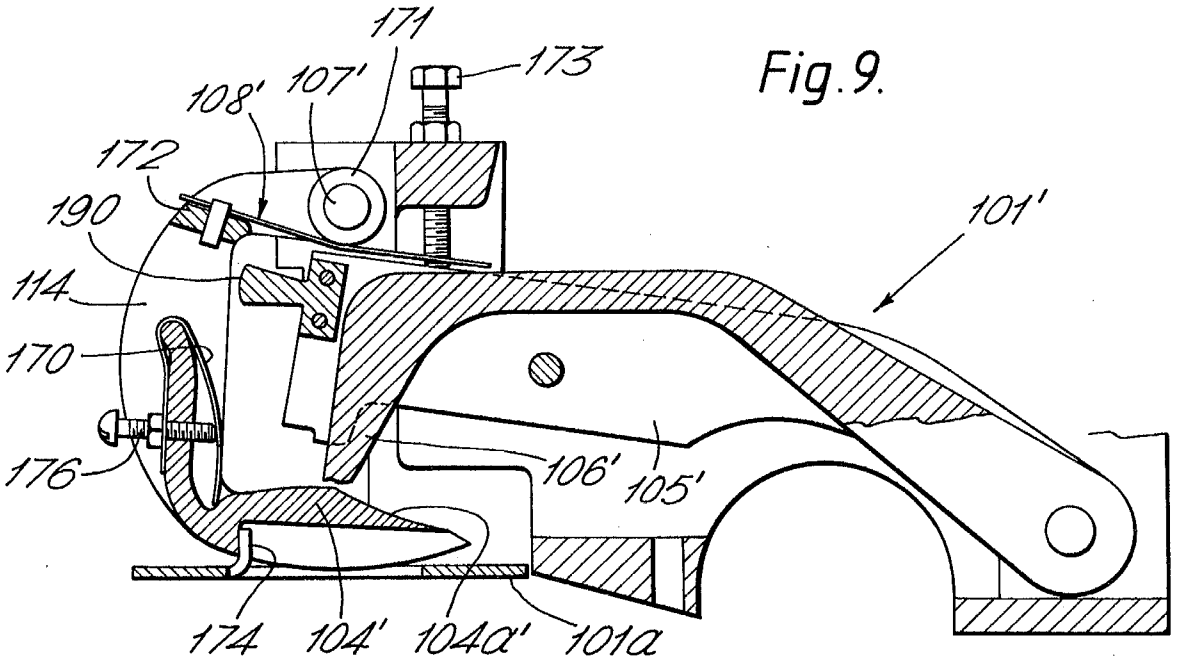

In order that the invention may be more readily understood, reference will now be made to the accompanying drawings in which:

FIG. 1 is a schematic side elevation of an exemplary form of photocopier having a finisher incorporating a stitcher according to this invention, FIG. 2 is a schematic view illustrating the principles of one embodiment of stitcher of this invention suitable for use in the finisher of FIG. 1, FIG. 3 is a scrap view of the stitcher shown in FIG. 2 illustrating schematically the relationship of various of its major parts, FIG. 4 is a schematic perspective view of the clincher showing the drive therefor, FIGS. 5 to 7 show schematically the structure and operation of the stitcher head illustrating the sequence of movements and interaction of the parts thereof, FIG. 8 is a side elevation of a second embodiment of stitcher according to the invention suitable for use in the machine shown in FIG. 1, and FIG. 9 is a section through the stitcher head of FIG. 8, with some parts omitted, showing the anvil locking mechanism in greater detail.

Referring to FIG. 1 there is shown an automatic xerographic reproducing machine 10 having a finisher 70 incorporating a stitcher 100 according to this invention. The copying machine 10 is capable of producing either simplex or duplex copies in sets from a wide variety of originals which may be advanced in recirculating fashion by recirculating document apparatus 12 described in U.S. Pat. No. 3,556,512. Although the present invention is particularly well suited for use in automatic xerography, the apparatus generally designated 100 is equally well adapted for use with any number of devices in which cut sheets of material are delivered or compiled in a set or stack.

The processor 10 includes a photosensitive drum 15 which is rotated in the direction indicated so as to pass sequentially through a series of xerographic processing stations: a charging station A, an imaging station B, a developer station C, a transfer station D and a cleaning station E.

A document to be reproduced is transported by document handling apparatus 12 from the bottom of a stack to a platen 18 and scanned by means of a moving optical scanning sytem to produce a flowing light image on the drum at B. Cut sheets of paper are moved into the transfer station D from sheet registering apparatus 34 in synchronous relation with the image on the drum surface. The copy sheet is stripped from the drum surface and directed to a fusing station F. Upon leaving the fuser, the fixed copy sheet is passed through a curvilinear sheet guide system, generally referred to as 49, incorporating advancing rolls 50 and 51. The advancing rolls forward the sheet through a linear sheet guide system 52 and to a second pair of advancing rollers 53 and 54. At this point, depending on whether simplex or duplex copies are desired, the simplex copy sheet is either forwarded directly to the finisher 70 via pinch rolls 61, 62 or into upper supply tray 55 by means of a movable sheet guide 56 before the finishing apparatus for the duplexed copy. Movable sheet guide 56, and associated advancing rolls are prepositioned by appropriate machine logic system to direct the individual sheets into the desired path.

The finisher 70 comprises a tray 71 having a base or support surface 72 inclined downwardly in the direction of sheet travel towards a registration corner defined by registration fences 74, 75 extending along the lower edge and one side of the tray. Above the upper end of the support surface is arranged a pair of coacting sheet feed rolls 64, 65 arranged to receive sheets fed along path 63 by pinch rolls 61, 62. From the feed rolls 64, 65, a sheet is directed by guide throat 78 towards the tray 71. A corner registration device 79 such as a paddle wheel like that described in U.S. Pat. No. 3,669,447 is arranged over the surface 72 to urge the sheets S into the registration corner to position them for receiving a stitch from the apparatus 100. The registration fence 74 is rotatable about an axis 74*a* so that it may be retracted for ejection of bound sets SS into a collection tray 69. Any suitable ejection mechanism, such as drive rollers, may be employed.

Referring now to FIGS. 2 and 3 of the drawings, the stitcher 100 comprises a stitcher head 101, a reel 102

(FIG. 1) from which wire W is supplied via a dancer (not shown) to the head 101 and an active clincher 201. The head 101 includes a wire advancing and cutting mechanism generally indicated at 103 for presenting lengths of cut wire to the stitcher head, an anvil 104 for supporting the wire, a former 105 including two elements at opposite sides respectively of the driver for forming the wire into a generally U-shape about the anvil and a driver 106 for driving the formed staple through the set SS. The clincher 201 comprises a clincher housing 202 having a clamping surface 203 by which a set SS may be clamped against the underside of the stitcher head 101 and containing clinch ears 204 arranged to receive and act upon staple legs driven through the set and into the housing through a slot in the surface 203.

In FIG. 2, the clincher 201 is shown in its operative position with a set SS positioned against the head 101 which is fixed in position above the compiler tray. It will be understood, however, that during compilation of the set, the clincher is lowered so that the clamping surface 203 is below the support surface 72 of tray 71. During a stitching operation the clincher 201 is raised to lift the set SS against the underside of the head 101 and clamp it in position. Variations in set thickness are accommodated by the drive mechanism 210 by which the clincher housing is raised to lift the set against the underside of the stitcher head and clamp it into position to receive a stitch. This mechanism comprises a force applying ring 205 which lifts the housing via a compression spring 206, being moved through a fixed distance by a lever 207 (see FIG. 4). The spring 206 is positioned between the force applying ring 205 and a shoulder 208 and the lever 207 which is arranged to pivot about axis 209 is actuated by a cam (not shown) which acts on its free end 207*a*. As shown in FIG. 4 the other end of the lever is bifurcated to form a yoke 207*b* which is pivotally connected to the force ring 205. The clincher housing 202 is supported and guided by a pair of arms 211 pivotally connected between the housing and the frame of the stitcher. The mechanism 210 in addition to accommodating varying set thicknesses, varies the clamping pressure applied to the set as a function of set thickness. Thus, the thinner the set the less the compression of spring 206 and the less the clamping force applied. The clincher ears 204 are positioned in fixed relation to the housing 202 so that they are always presented to the set in the same relation regardless of the set thickness.

The wire advancing and cutting mechanism 103 comprises movable wire advancing and cutter blocks 120, 121 and an inhibitor member 124 positioned by the clincher 201 in dependence on the thickness of the set of sheets SS. The blocks 120, 121 include wire diodes 122, 123 which grip the wire only against movement relative to the respective block in the direction opposite the wire advancing direction. Thus, the diodes grip the wire when the blocks are moved to the left but allow each block to be moved to the right along the wire while the other block holds the wire. At the start of a wire feed cycle, the blocks 120 and 121 are positioned as shown in dotted lines in FIG. 1. To feed the wire W, the advancing block 120 is moved to the left, its diode 122 gripping the wire, to advance the wire past the rest or start-of-cycle position of the cutter 125 by a distance made up of a constant (crown length plus twice clinch length) plus the set thickness and the cutter block is retracted from its rest position by a distance equal to the set thickness. These movements and thus the length of wire W presented to the stitcher head 101 for severing by the cutter 125 are determined by the inhibitor member 124 which limits the movement of the blocks 120, 121, according to the thickness of the set. The blocks 120, 121 are shown in full lines in their final positions at the end of a wire advancing movement. As the mechanism recycles to its start position (which takes place at the end of the complete stitching cycle) the cutter block 121 returns to its rest position pulling the wire with it—so that the wire end is always in the same position at the start of a feed cycle—and the advancing block 120 traverses back along the wire to its rest position.

While the inhibitor member 124 may be directly connected to the clincher housing 202 as schematically represented in FIG. 2, other arrangements are possible. Thus in a second embodiment as shown in FIG. 8, the inhibitor member 124' is carried on an arm 143 pivoted to the stitcher head at 144 and is positioned by means of an actuator 145 mounted on one of the clincher housing guide arms 211'. As shown the actuator is adjustable for correctly setting the mechanism and comprises a bolt 146 threaded through a bracket 147 and locked into position by a nut 148. While the clincher is retracted, the inhibitor is supported by a limit stop 149.

The embodiment of FIG. 8 also includes a modified drive for the force ring 205' in which as a space-saving measure, the lever 207' carries a cam follower 270 intermediate the force ring 205' and pivot axis 209' which is controlled by a face cam 219 the centre-line of the guideway of which is shown by the dash-dot line 219*a*. The cam 219 is mounted on a cam shaft 218.

The length of wire presented to the stitcher head 101 by the mechanism 103 is cut, formed and driven in the following manner. While the anvil 104, which is pivotally mounted at 107 and biassed to its start-of-cycle position by a spring 108 as shown in FIG. 2, is held against movement, the driver 106 is moved downwardly against the wire to clamp it in position on the anvil. The former elements 105 then start moving downwardly. Initial movement of the former operates the cutter 125 through actuator 109 to sever the required wire length and further movement thereof shapes the wire about the anvil 104 into a generally U-shape. In order to accommodate the wire during this operation, the formers have guide grooves 110 along their inner faces. At the end of the forming operation the former is in its lower limit position with the lower ends of the former elements 105 below the underside of the anvil 104 and adjacent the set. The driver is now driven downwardly, the anvil pivoting about its axis 107, to drive the formed staple. As seen in FIG. 3, the anvil includes a sloping surface 104*a*. During the driving operation the anvil surface 104*a* forms a support for the crown of the staple. Similarly the former elements serve to support the legs of the staple in the grooves 110 during the driving movement.

It will be realised from the foregoing that the anvil must be held against movement during the cutting and forming stage but be pushed out of the way during the driving stage. This may be achieved by using a spring 108 which is strong enough to hold the anvil stationary during cutting and forming. However, this requires that the force available to drive the driver must be sufficient also to overcome the resistance of the spring. It is preferred therefore that as described with reference to our copending Ser. No. 106,324 filed concurrently herewith, the anvil be held locked in position during the cutting and forming stage and released by the former 105 at the end of its travel whereby only a relatively light spring 108 is required which is sufficient to return the anvil to its start-of cycle position and to ensure that the anvil supports the staple crown during the driving stage. One way of achieving this is shown in FIG. 8 in which the anvil is geometrically locked in position during the cutting and forming steps by arranging the pivot axis 107′ above the line of pressure engagement between driver and anvil, the lock being released by a projection 190 on the former engaging an actuator surface 170 on the anvil support arm. Another method of locking the anvil during forming is described with reference to FIGS. 5 to 7.

As described above, the stitcher has a two stage driver action in which following wire feed a first stage motion operates to grip the wire W against the anvil 104 during cutting and forming and a second stage motion acts following forming to effect driving of the formed staple. A mechanism 400 suitable for this operation based on pivoted motions which first holds the wire against the anvil and then provides the driving motion all from one continuous input lever travel is described with reference to FIGS. 5 to 7.

The ends of the staple legs are turned over and wiped flat against the underside of the set by the clincher ears 204. The clincher 201 is operated as described more fully in our copending Ser. No. 106,197 filed concurrently herewith so that the staple legs having passed through the set move through air and meet no further resistance during driver travel. This is achieved by arranging the clincher ears out of the paths of the staple legs during driver travel so that leg wander is accommodated wholly within the clinch ears by profiling the ears with a groove wide enough to accommodate the maximum leg wander anticipated. The drive to the clincher ears may be by a spring which is loaded during return motion of the clincher housing at the completion of a stitching operation as more fully described in our copending Ser. No. 106,193 filed concurrently herewith, the clinch ears being held latched in the position shown in FIG. 2 prior to the operation thereof, or by a cam drive 250 as illustrated in FIG. 8. The clincher rod 213 is driven by an edge or ramp cam 250 mounted on the same drive shaft 218 as, and alongside, the cam 219 which drives the force-ring lever 207′. The drive to the clincher rod from the cam 250 is effected by a roller follower 251 mounted on one end of a crank arm 252 pivoted to a bracket 253 depending outwardly from the clincher housing 202′. The other end of the crank arm carries a stop 254 which engages the bottom end of the clincher rod 213. As shown, the stop 254 is adjustable to permit setting of the clincher ear movement. The clincher ears 204′ are biassed to their open, retracted position by a spring schematically represented at 255. The cam shaft 218 is driven in synchronism with the cam shaft 414 (see below) and the cam 250 is disposed so that the clincher rod is driven only after the formed staple has been completely driven through the set. It will be noted that by using a drive arrangement as shown with the face cam 250, variations in set thickness are accommodated without affecting the timing (except to an insignificant degree caused by slight variations in the position of the cam follower 251 to cam 250) of the clincher ear movement relative to that of the driver.

The mechanism 400 for driving the former and driver will now be described with reference to FIGS. 5 to 7. The driver 106 and former 105 are pivotally mounted about common pivot axis 401. A yoke 402 pivoted to the former 105 has its free end 403 resting on the driver 106. The yoke 402 is connected intermediate its ends to one end of a drive lever 404 by a link 405. The link 405 is pivotally connected to the yoke 402 and lever 404 to permit relative movement of these elements. The drive lever 404 is pivotally mounted, as shown about axis 401, and carries a roller follower 406 acted upon by a drive cam (not shown) which operates to drive the lever in a continuous motion which effects discontinuous movements of the driver and former in the manner illustrated in FIGS. 5 to 7. FIG. 5 shows the stitcher head in its start-of-cycle position with the driver 106 and former 105 raised. A wire length is fed between driver 106 and anvil 104 during which operation the lever 404 is stationary. Following wire feed a continuous lifting movement of the cam follower 406 is initiated which first drives the driver downwards to clamp the wire against the anvil, movement of which is inhibited as by a locking bar or shaft 150. As the lever 404 continues to move, the yoke 402 pivots about its point of engagement with the driver 106 and the former 105 is depressed into the position shown in FIG. 6. During this movement the former 105 first actuates the wire cutter 125 as described above and then shapes the wire into a staple about the anvil 104. The former continues to descend to its lower limit position (seen in FIG. 7) in which it releases the anvil by rotating the locking bar 150. Further movement of the lever 404 depresses the driver as shown in FIG. 7 to drive the formed staple until the crown of the staple engages the set. The system is returned to its start-of-cycle position by the lever 404 being returned to the position shown in FIG. 5, the driver being spring-biassed upwardly and upward movement of the former being limited by a stop 173.

In a second embodiment of stitcher according to the invention as shown in FIG. 8, an alternative embodiment of mechanism 400 is employed. Here, the drive lever 404′ is cranked and includes two generally side-by-side portions 404*a* and 404*b* which are rigidly fixed with respect to each other for rotation about an axis 411 which in this instance is spaced from the axis 401′ of the driver 106′ and former 105′. The cam follower 406′ is mounted on the end of portion 404*a* and is engaged by a face cam shown in broken lines at 412, the centre-line of the guideway of which is represented by the dash-dot line 413, the cam being mounted on cam shaft 414. Further, the yoke 402′ is arranged between the elements of the former 105′ and is pivotally connected to the driver at 415 (for the reason explained below) as well as to the former at 407′. The latter connection is achieved by stub shafts 407*a* on the yoke engaging in slots 407*b* in the former elements 105′ so as to permit the necessary pivoting motions of the assembly.

As best shown in FIG. 9, the geometric lock for the anvil is achieved by arranging that the driver press the wire against the anvil along a force plane extending through the pivot axis 107′ of the anvil and the line along which the wire lies on the anvil. The anvil pivot 107′ is shown above the anvil surface and the anvil and its integral support arm form a generally U-shaped member 114. The member 114 is pivotally supported by an axle 171 and the spring 108′ takes the form of a bundle of leaf springs secured between a flange 172 on member 114 and the axle 171, being anchored to the flange 172. The springs act on the top of the driver with the desirable result that since, as the anvil pivots, the driver correspondingly descends, an approximately constant force is exerted by the spring bundle 108′. The anvil limit position beneath the driver 106 is defined by a stop 174 formed by a lip pressed out of the set support surface 101*a* of the stitcher head. The member 114 carries a curved actuator surface 170 which is acted upon by the projection 190 on the former 105' to break the geometric lock and unlatch the anvil to position the wire on anvil surface 104*a* which is so shaped that as described above the driver progressively swings the anvil aside during the driving step against the force of the spring 108', the anvil supporting the crown of the staple during this operation. The actuator surface 170 is adjustable by an adjuster 176.

Thus, whereas in the embodiment shown in FIGS. 5 to 7, the driver is biassed away from the anvil, in this embodiment it is biassed towards the anvil and the return motion of the driver is obtained through its connection 415 with the former, the upper limit position of which is defined by stop 173.

It will be appreciated that with the arrangement shown in FIGS. 8 and 9, a considerable space saving is achieved as compared with that exemplified in FIGS. 5 to 7.

Whilst specific embodiments of the invention have been described above it will be understood that various modifications may be made to the specific details referred to herein without departing from the scope of the invention as defined in the appended claims. Thus, the principles of this invention although described in relation to a flat bed stitcher may equally be applied to a saddle stitcher.

Further, while in the apparatus described above the stitcher is fixed in position, it may be movable for varying the position of the stitch or for inserting more than one stitch in a set. Also, two or more stitchers according to the invention, which may themselves be movable, may be operated in tandem, in which case various of the drive elements may be common to avoid duplication.

It will also be understood that while in the embodiments described, the stitcher head is fixed, the clincher could be fixed and the clamping means be formed by the sheet receiving surface of the head itself.

It will further be understood that although the embodiments of stitcher described and illustrated show the stitcher head above the clincher, the stitcher may be arranged in any suitable orientation and specifically the clincher may be arranged over the stitcher head.

For clarity, it is to be noted that the term staple is used herein to mean either a wire-fastener which is pre-formed outside the stitching machine or one which is formed within the machine.

The ends of the staple or stitch legs may be turned over by an active clincher including ears which are wiped against the leg ends as described above or by a passive clincher having fixed guide surfaces. The advantage of an active clincher is that the legs are wiped flat against the set.

What is claimed is:

1. A wire stitcher apparatus having a driver and an anvil for forming a staple from cut wire lengths about the anvil, the improvement including a former on the driver and a lever, means for imparting continuous motion to the lever, said continuous motion being arranged to impart movement to the driver and said former and to position said driver against a cut wire length for holding the same against said anvil, said motion imparting continued movement to said former for forming a staple around said anvil, and means for arresting motion of the driver during said forming.

2. The stitcher apparatus according to claim 1 including lever means for moving the driver and said means for forming by which the wire is formed about the anvil.

3. The stitcher apparatus according to claim 1 wherein the lever is linked to a yoke by which motion of the lever is transmitted to the driver and former permitting relative movement thereof while urging them to move together.

4. The stitcher apparatus according to claim 3 wherein the former and driver are carried on pivot arms having a common pivot axis.

5. The stitcher apparatus according to claim 4 wherein one end of said yoke is pivotally connected to the former and the other end acts on the driver.

6. The stitcher apparatus according to claim 4 wherein said yoke is pivotally connected to the former and the driver.

7. The stitcher apparatus according to claim 6 wherein the lever is pivotally mounted and driven by a cam.

8. The stitcher apparatus according to claim 1 including a cutter for cutting the wire from a supply of wire, the cutting being effected while the wire is gripped against the anvil by the driver.

* * * * *